United States Patent [19]

Davis et al.

[11] 3,937,146

[45] Feb. 10, 1976

[54] DUAL SIGNATURE SAFETY AND ARMING MECHANISM

[75] Inventors: Harry J. Davis, Wheaton, Md.; Leo P. Rongus, Washington, D.C.

[73] Assignee: The United States of America as represented by the Secretary of the Army, Washington, D.C.

[22] Filed: May 22, 1974

[21] Appl. No.: 472,247

[52] U.S. Cl. ..... 102/78; 102/70 R

[51] Int. Cl.[2] ..... F42C 1/04; F42C 15/24

[58] Field of Search ..... 102/70.2 R, 70 R, 70 B, 102/70 C, 70 F, 70 AC, 70 S, 70.2 A, 70.2 G, 70.2 F, 70.2 P, 78, 81

[56] References Cited

UNITED STATES PATENTS

| | | | |
|---|---|---|---|
| 2,730,046 | 1/1956 | Bergstrom et al. | 102/81 |
| 2,980,020 | 4/1961 | Smith | 102/70.2 |
| 3,102,476 | 9/1963 | Naeseth | 102/16 |
| 3,545,382 | 12/1970 | Abt | 102/78 |
| 3,648,611 | 3/1972 | Noel | 102/16 |
| 3,779,169 | 12/1973 | Backstein et al. | 102/81 |
| 3,786,759 | 1/1974 | Mellen et al. | 102/80 |
| 3,807,308 | 4/1974 | Malatesta | 102/78 |
| 3,848,531 | 11/1974 | Mellen | 102/80 |

*Primary Examiner*—Samuel W. Engle
*Assistant Examiner*—S. A. Cangialosi
*Attorney, Agent, or Firm*—Nathan Edelberg; Robert P. Gibson; Saul Elbaum

[57] ABSTRACT

A dual signature arming mechanism responsive to acceleration to cock a firing pin and responsive to propellant combustion gas pressure to pyrotechnically release a pivotally mounted detonator which rotates into position relative to said firing pin. A plunger restrained by the pyrotechnic release is provided to disable the arming mechanism if the pyrotechnic release is activated before a specific velocity is reached.

9 Claims, 9 Drawing Figures

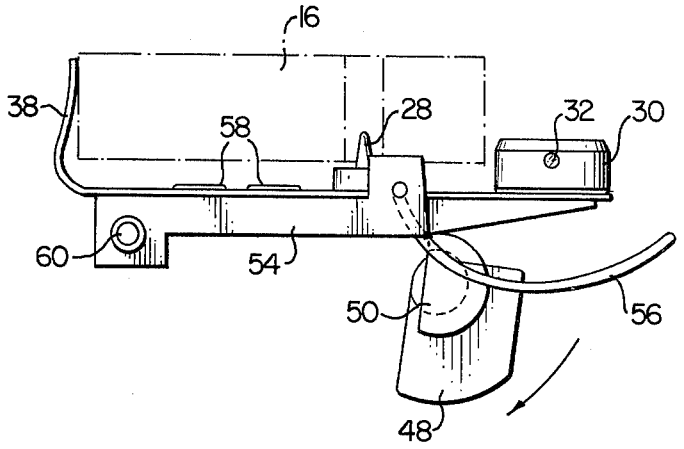
FIG. 5
FIG. 6
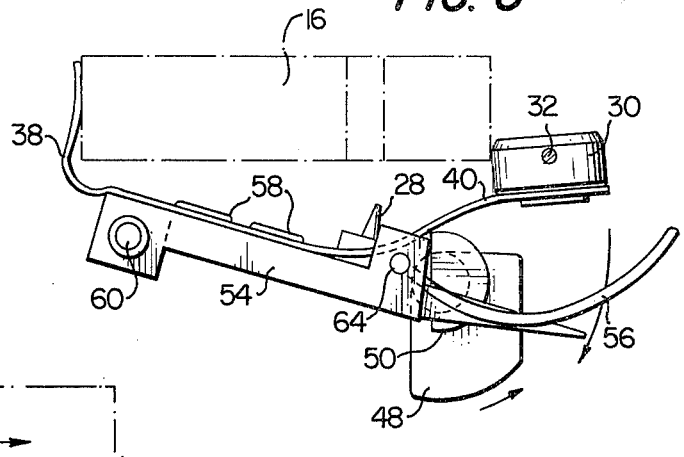
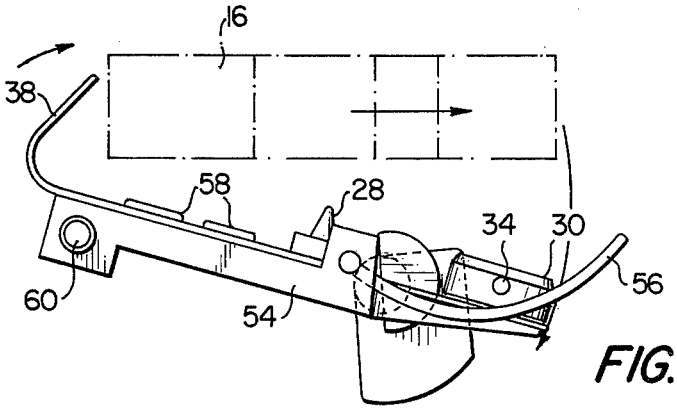
FIG. 7
FIG. 9
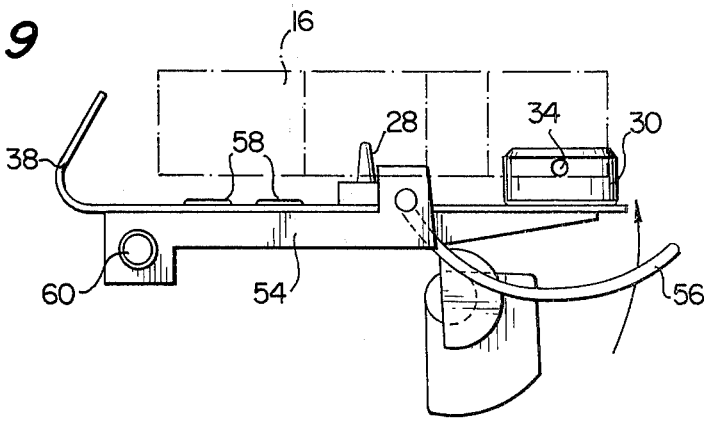

DUAL SIGNATURE SAFETY AND ARMING MECHANISM

RIGHTS OF THE GOVERNMENT

The invention described herein may be manufactured, used and licensed by or for the United States Government for governmental purposes without the payment to us of any royalty thereon.

BACKGROUND OF THE INVENTION

1. Field of the Invention

The present invention relates generally to safety and arming mechanisms for explosive fuzes and more particularly to a dual signature safety and arming device.

2. Description of the prior art

In ordnance missiles, which commonly carry explosive charges, it is desirable that missiles remain safe or unarmed until after they have been fired. This insures maximum safety of the personnel concerned, yet enables the explosives to cause damage to the target. Various means are used to secure this result. For example, rotating missiles have been equipped with arming mechanisms which are responsive to the centrifugal force developed when the missile is fired. Non-rotating missiles, such as mortar shells, certain classes of rockets, and the like are ordinarily equipped with arming mechanisms which are responsive to the forces of setback, which occur when the missile is launched.

Until recently, many such arming devices were not shockproof. Thus, the missiles could accidentally be placed in the armed condition if they were dropped or otherwise subject to a strong mechanical shock. U.S. Pat. No. 2,625,881 provides a double element release to solve this problem in which the double element setback lock is a linear two degree of freedom mechanism.

In smaller projectiles, for example, shoulder-launched grenades, the safety and arming mechanisms of the prior art have been generally too large to be incorporated therein. Thus, there exists a need for a small, dual signature safety and arming mechanism having a delay therein.

SUMMARY OF THE INVENTION

The present invention provides a dual environment arming signature to provide an arming delay for crew safety and does not involve stored energy to drive its arming structure. The first environment is a setback mechanism using a system of springs and masses responsive initially to the acceleration of the projectile to cock and arm the arming mechanism. Two spring mass systems provide the two degrees of freedom which act sequentially and which bias a pivotally mounted detonator to move it to an arming position and to cock a firing pin for the detonator.

The second arming signature uses the propellant gas pressure as the second environment. The gas pressure is used to initiate a thermal battery power supply; and, upon obtaining a pre-specified voltage, electrical energy drawn from the battery is used to ignite a pyrotechnic. Upon completion of the pyrotechnic element's burning, a detent or lock, which has previously prevented the biased detonator housing from moving, is released by the pyrotechnic element to allow the detonator to rotate into the armed position. Arming delay is provided by the time needed for the battery to come up to the specific voltage and the time needed for the pyrotechnic element to complete its burning.

A spring biased plunger, also retained by the pryotechnic element, is provided to disable the arming mechanism if the pyrotechnic element is actuated before a specific velocity is reached to actuate the setback mechanisms which are responsive to the first arming environment. The external dimensions of the present safety and arming mechanism has an overall diameter of approximately one inch and a height under ½ inch, therefore making it suitable for the space allocation required in smaller missiles.

OBJECTS OF THE INVENTION

An object of the present invention is to provide a non-linear dual arming signature safety and arming device.

Another object is to provide an safety and arming device using a thermal battery and pyrotechnic delay.

Further object of the invention is to provide a dual signature arming device which is extremely small and capable of mass production.

Still another object of the present invention is to provide a safety and arming device which is responsive to acceleration as a first arming signature and propellant gas pressure as a second arming signature.

A still further object of the present invention is the provision of a safety mechanism to disable the safety and arming device if the dual arming signatures occur in reverse order.

Other objects, advantages and novel features of the present invention will become apparent from the following detailed description of the invention when considered in conjunction with the accompanying drawings.

BRIEF DESCRIPTION OF THE DRAWINGS

FIG. 5 is a detailed view of the setback mechanism after rotation of an eccentrically mounted weight responsive to velocity;

FIG. 6 is a detailed view of the setback mechanism cocked;

FIG. 7 is a detailed view of the setback mechanism after the pyrotechnic release of the rotary detent;

FIG. 9 is a detailed view of the setback system after the firing pin collides with the detonator.

DETAILED DESCRIPTION OF PREFERRED EMBODIMENTS

Figure 1:
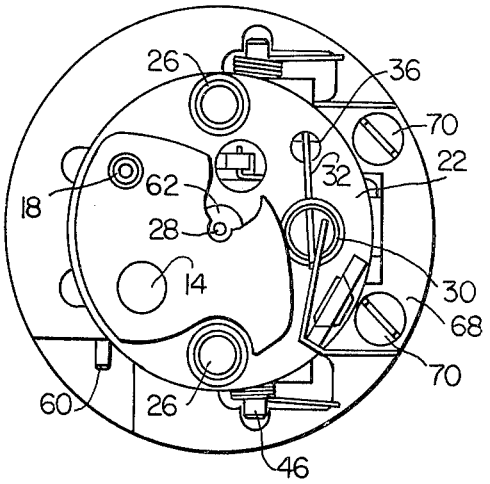
FIG. 1 is a top view of the dual signature safety and arming mechanism of the present invention with the top plate removed.
Figure 2:
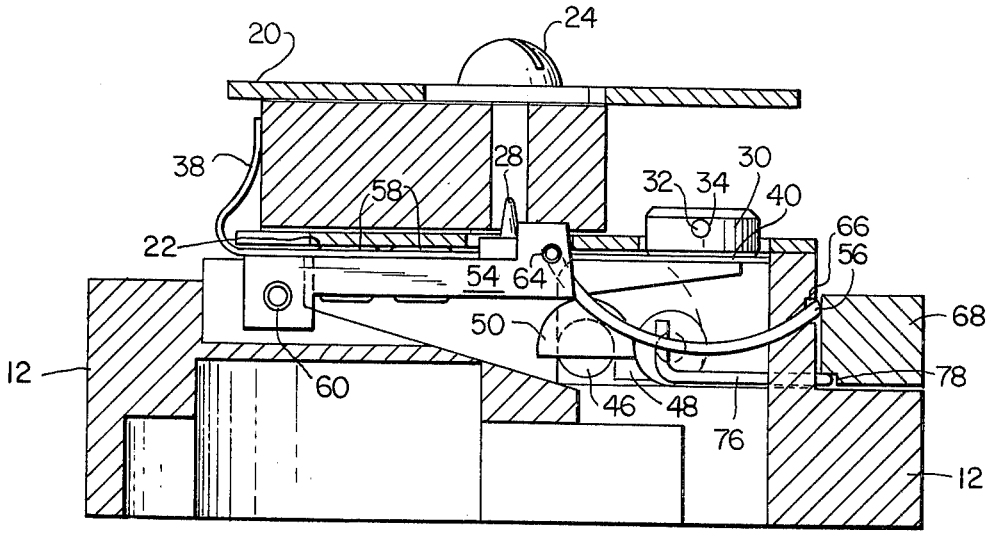
FIG. 2 is a side cut-away view taken along lines 2—2 of FIG. 3, with the top plate in place.

As shown in FIGS. 1 and 2, the safety and arming mechanism has a base member 12 upon which are mounted the setback mechanisms and the rotary carriage for the detonator. A detonator 14, for example, a stab detonator, is carried in carriage 16 which is rotatably mounted by pin 18 between plates 20 and 22. The total detonator carriage assembly is secured to the base 12 by fasteners 24 in apertures 26.

The recess in the bottom of housing 12 is adapted to receive the power supply and associated electronics of the fuze therein. The general configuration of the safety and arming mechanism may be considered a dual cylinder two-tiered configuration. The overall diameter of base member 12 is approximately 1 inch and the height from the top of the recess to the top of the second tier above fastener 24 is approximately one-half inch. These overall dimensions allow the safety and arming device to conveniently fit in the space allotted in smaller missiles and projectiles, for example, shoulder-launched grenades.

The two signature safety and arming device is shown in FIGS. 1–4 in the safe condition. The stab detonator 14 in rotary carriage 16 is kept from a centerline of housing 12 by the firing pin 28 and by the rotary lock or detent 30. A pyrotechnic wire or cable 32 has one end secured to bottom plate 22 of the detonator carriage and is received in and traverses the rotary lock 30 through an aperture 34. The other end of pyrotechnic cable 32 traverses a hole 36 in the bottom plate 22 wherein it acts as a detent to a safety mechanism to be described later on. The pyrotechnic cable 32 keeps the rotary lock 30 adjacent to and in the plane of rotation of the detonator carriage assembly 16 and prevents it from rotating. A drive spring 38, which drives the detonator carriage 16 into line so as to place the stab detonator 14 along the centerline over firing pin 28, is not cocked and therefore stores no energy. The spring 40, on which is mounted rotary lock 30, is likewise uncocked. The motion of the rotary carriage 16 is controlled by first and second setback elements 42 and 44, respectively, as well as by the rotary lock 30. Details of the setback element, as well as the sequential operation are shown in FIGS. 3–6.

The first setback element 42 consists of a shaft 46 which extends across and is mounted to the base 12. Two eccentric weights 48 are mounted to shaft 46 as are two half-shafts 50. Two springs 52 are coiled around shaft 46 having one end received in the eccentric weights 48 and the other end resting against base 12. The springs 52 keep the weights biased in the forward or up position. The mass of the weights and the resiliency of the springs defined the predetermined acceleration which the safety and arming mechanism must experience before the eccentrically mounted weights 48 will rotate. Once this acceleration has been obtained, the weights will rotate which in turn will cause shaft 46 to rotate carrying half-shafts 50 therewith. As will be explained more fully below, the half-shafts 50 are cam elements which support the second setback element 44 until rotated to the down position at the preselected velocity. The predetermined acceleration or setback forces acting through the center of mass to the first setback element causes the shaft 46, weight 48 and half-shafts 50 to rotate against the retarding force caused by the moment of inertia of the elements, friction and biasing of spring 52. The resulting configuration is shown in FIG. 5.

The second setback element 44 consists of the drive spring 38, a clapper-type firing pin arm 54, firing pin 28, rotary lock 30, rotary lock drive spring 40 and setback spring 56. The drive spring 38 and the rotary lock drive spring 40 are shown as one continuous spring, though they may be two separate springs. The drive springs 38 and 40 and the firing pin 28 are secured to the firing pin arm 54 by fasteners 58, which may be for example, rivets. The firing pin arm 54 can be considered a generally Y-shaped element with the base of the Y supporting drive spring 40 and the top two ends of the Y rotatably mounted on a shaft 60 which is secured to the base 12. The firing pin arm 54, drive spring 40, and the rotary carriage base plate 22 have an aperture 62 therein to receive the firing pin 28.

The setback spring 56 is generally U-shaped having its two ends received within apertures 64 in the firing pin arm 54. The base or bight of the U-shaped setback spring is received in a slot 66 in the base 12. A plate 68 is secured to the base 12 by fasteners 70 to prevent the bight of setback spring 56 from moving out of slot 66. It should be noted that shaft 60 and the slot 66 lie generally in a line which defines a fixed fulcrum line whereas the aperture 64 into which the two ends of the setback spring 56 fit defines a movable fulcrum point. When the device is in the safe condition as indicated in FIGS. 1–4, the moving fulcrum point of aperture 64 lies above the fixed fulcrum line defined by points 60 and 66.

When the half-shafts 50, which are generally adjacent to and in contact with the bottom of firing pin arm 54 approximately below apertures 64, rotate with shaft 46 in response to the rotation of eccentric weight 48 so as to clear and release the firing pin arm 54. The setback forces or acceleration moves the firing pin arm 54 down against the retarding forces caused by the moment's inertia of the total system, by the drive springs 38 and 40 as they are cocked, and by the bias of the setback spring 56. The configuration of the elements at the end of the travel is shown in FIG. 6. It should be noted that the setback spring 56 has moved over its centers as defined by the fixed fulcrum and now acts as an anti-creep bias spring on the firing pin arm 54.

As can be seen in FIG. 6, the rotary drive spring 38 is cocked and is applying pressure on the rear of the detonator carriage 16 which in shown in phantom. The firing pin 28 has been lowered out of aperture 62 so as to allow the carriage to rotate forward. Rotary lock 30 now slants forward and engages the forward edge of the detonator carriage 16 and prevents it from rotating. Thus, the dual signature safety and arming device of the present invention has responded to the first signature environment; namely, the achievement of a specific velocity which is measured by the first setback means.

The second signature environment, which in the present invention has been defined as the propellant gas pressure, is required to complete the arming of the device. The propellant gas pressure is used to initiate a primer actuated thermal battery powered supply. A battery supply suitable to perform the desired function is described in U.S. Pat. No. 3,450,046, which is incorporated herein by reference. Once the thermally battery powered supply has been activated and upon obtaining a pre-specified voltage, electrical energy drawn from the battery is used to ignite the pyrotechnic cable 32. Once the pyrotechnic cable has burned through, rotary lock 30 is released and rotates downward out of the plane of the detonator carriage 16 in response to drive spring 40 and allows the detonator carriage 16 to rotate under the biasing of drive spring 38. The resulting configuration is shown in FIGS. 7 and 8.

Figure 8:
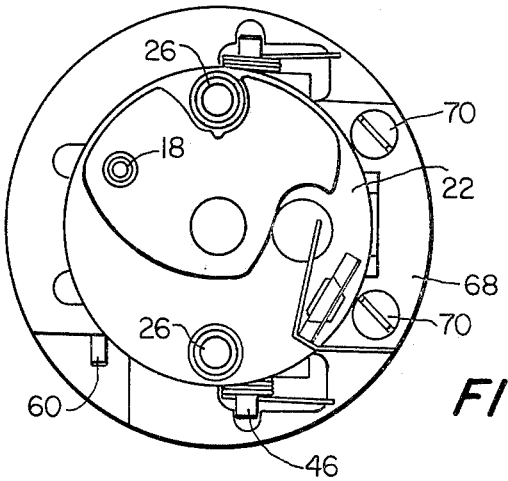
FIG. 8 is a top view of the present invention with the top removed after rotation of the detonator carriage to the armed position.

In the configuration shown in FIGS. 7 and 8, the detonator 14 is rotated so as to be in line with and directly over, the firing pin 28. Thus, the dual signature safety and arming mechanism of the present invention has responded in sequence to a acceleration signature and a propellant gas pressure signature to arm the present detonator.

The fuze's electrical detonator is so located below the firing pin that its ignition will drive the firing pin forward into the stab detonator 14, setting off the round. On the other hand, the firing pin 28 can move forward into the stab detonator 14 due to the inertial force generated during impact. The fired configuration is depicted in FIG. 9.

The delay in arming the safety and arming mechanism of the present invention is provided by the use of a pyrotechnic cable. The arming delay is the sum of the time needed for the battery to come up to the voltage sufficient to ignite the pyrotechnic cable as well as the time needed for the pyrotechnic cable to complete its burn.

Although the propellant gas pressure has been used to activate the pyrotechnic device, the pyrotechnic device may be ignited using other means. For example, the pyrotechnic device may be ignited by extending it into the base of the projectile and directly exposing it to propellant gas; or, the wire may be exposed directly to the gas or a striker used to initiate the power supply.

Figure 3:
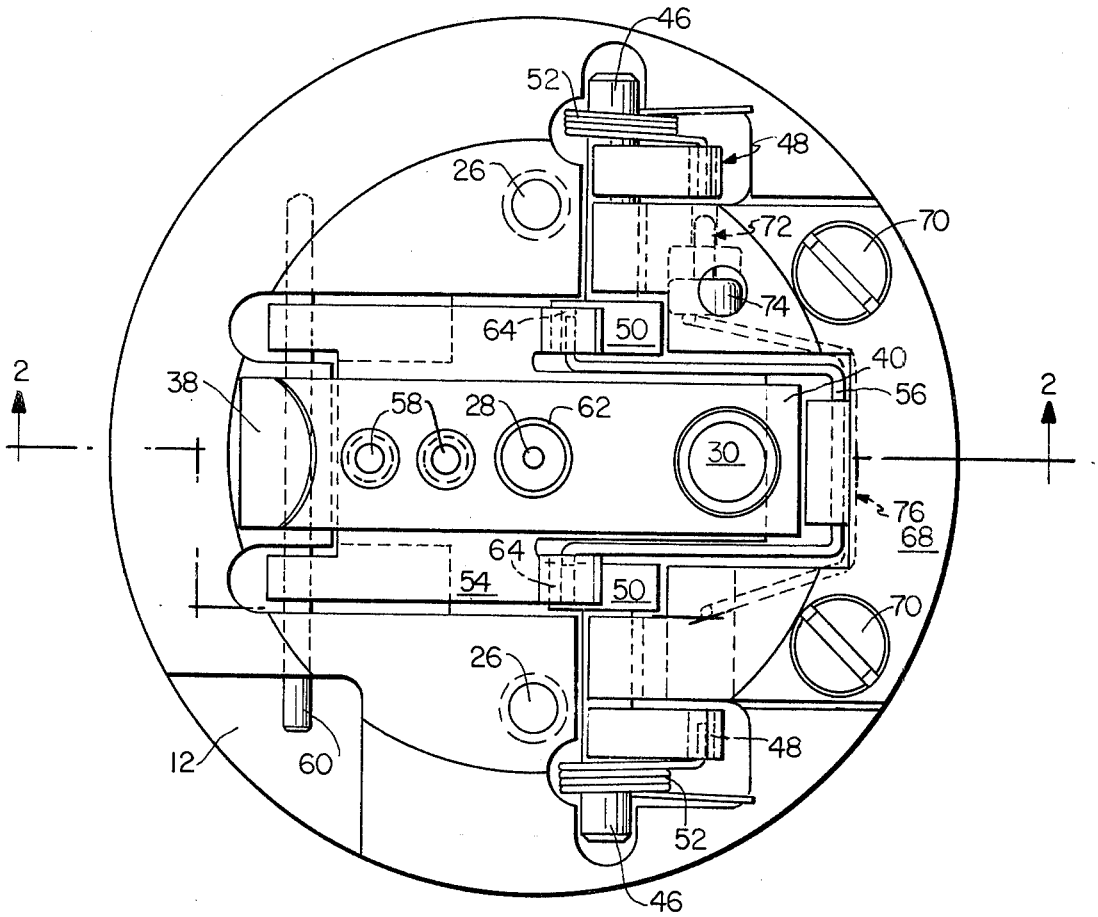
FIG. 3 is a top view of the subject invention with the rotary detonator carriage removed.
Figure 4:
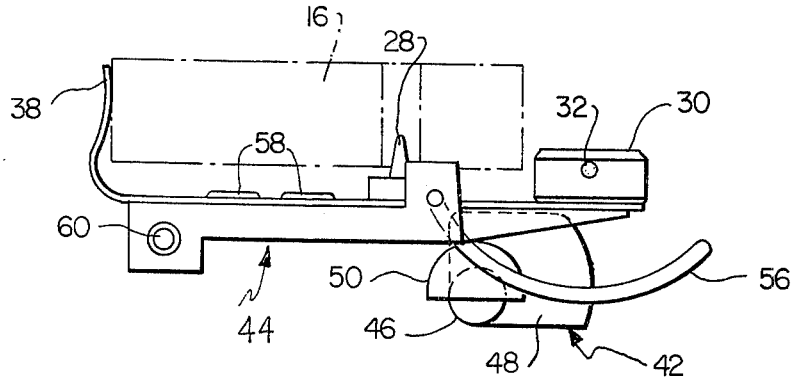
FIG. 4 is a detailed view of the setback mechanism in its initial position.

As shown in detail in FIGS. 2 and 3, a failsafe detent system is provided to disarm the setback mechanisms if the pyrotechnic cable 32 should be destroyed before the activation of the setback mechanism. This is to guard against the premature igniting of the pyrotechnic device as, for example, in a warehouse fire. The failsafe mechanism includes a plunger 72 having a collar 74. The collar 74 is engaged and retained in the inoperative position by the pyrotechnic cable 32. A biasing element or spring 76 is U-shaped and received within recess 78 in the base of plate 68. Spring 76 engages the back of collar 74 and urges the plunger 72 against the pyrotechnic cable 32. In the normal operation of the present invention, concentric weight 48 rotates down and out of the line of sight of plunger 72 before the pyrotechnic cable 32 releases the plunger. If the pyrotechnic cable 32 should prematurely ignite, plunger 72 would be released under the urging of biasing spring 76 and would move forward to engage and lock concentrically mounted weight 48 and thereby prevent it rotating downward. The disabling of the first setback element by preventing weight 48 from rotating, keeps the firing pin arm 54 in place and firing pin 28 in aperture 62 of the detonator carriage 16 and prevents the detonator from rotating into the armed position. Thus, the system is failsafe and prevents arming if the signature environments occur in reversed order.

We wish it to be understood that we do not desired to be limited to the exact details of the construction shown and described, for obvious modifications can be made by a person skilled in the art.

What is claimed:

1. In a combination of an arming mechanism, a firing pin and a detonator, said detonator being pivotally mounted to said mechanism to rotate in a first plane, said mechanism comprising:

first means responsive to the acceleration forces on said arming mechanism for biasing said detonator to rotate from a first position to an armed position;

second means adjacent said detonator for initially detaining said detonator from moving to said armed position; and third means connected to said second means and pyrotechnic means for moving said second means out of said first plane to allow said first means to rotate said detonator to said armed position.

2. The arming mechanism of claim 1 wherein said third means includes a fourth means for biasing said second means to move out of said plane and fifth means connected to said second means for maintaining said second means in said plane until said fifth means is pyrotechnically altered.

3. The arming mechanism of claim 2 wherein said fourth means includes a first spring having said second means mounted on one end, said first means includes a sixth means adjacent said spring and responsive to said acceleration forces for allowing said first spring to flex, said first means includes the other end of said first spring for biasing said detonator.

4. The arming mechanism of claim 3 wherein said firing pin includes a firing pin arm pivotally mounted to said mechanism at one end, a biasing means connected to the other end of said firing pin arm to maintain said arm in a cocked position, and said first spring is mounted to said firing pin arm.

5. The arming mechanism of claim 3 wherein said sixth means includes a weight eccentrically mounted to a shaft, a cam means mounted to said shaft for initially preventing said first spring from flexing and a biasing means for retarding rotation of said weight, said weight rotating said shaft in response to a predetermined acceleration to uncam said first spring and allow it to flex.

6. In a combination of an arming mechanism, a firing pin and a detonator, said arming mechanism comprises:

first means responsive to the acceleration force of said arming mechanism for biasing said detonator to move from a first position to an armed position;

second means adjacent said detonator for initially detaining said detonator from moving to said armed position;

third means including a pyrotechnic wire connected to said second means for maintaining said second means adjacent said detonator; and fourth means for actuating said pyrotechnic wire to release said second means and allow said first means to move said detonator to said armed position.

7. The arming mechanism of claim 6 wherein said fourth means is responsive to propellant combustion gas pressure for pyrotechnically activating said third means.

8. The arming mechanism of claim 7 wherein said fourth means includes a thermal battery activated by a fifth means responsive to said propellant combustion gas pressure.

9. The arming mechanism of claim 6 including a fifth means biased to move to engage said first means and restrained by said pyrotechnic wire for preventing activation of said first means if said pyrotechnic wire is activated before said first means.

* * * * *